US008831267B2

(12) United States Patent
Annacone

(10) Patent No.: US 8,831,267 B2
(45) Date of Patent: Sep. 9, 2014

(54) AUDIO JACK SYSTEM

(76) Inventor: William R. Annacone, Stowe, VT (US)

( * ) Notice: Subject to any disclaimer, the term of this patent is extended or adjusted under 35 U.S.C. 154(b) by 350 days.

(21) Appl. No.: 13/309,495

(22) Filed: Dec. 1, 2011

(65) Prior Publication Data

US 2013/0010986 A1 Jan. 10, 2013

Related U.S. Application Data

(60) Provisional application No. 61/571,788, filed on Jul. 5, 2011.

(51) Int. Cl.

| | |
|---|---|
| ***H04R 25/00*** | (2006.01) |
| ***H01R 31/06*** | (2006.01) |
| *H04R 1/02* | (2006.01) |
| *H01R 24/58* | (2011.01) |
| *H04R 1/10* | (2006.01) |
| *H01R 105/00* | (2006.01) |

(52) U.S. Cl.

CPC ..... *H01R 31/06* (2013.01); *H01R 24/58* (2013.01); *H04R 2420/09* (2013.01); *H04R 1/1041* (2013.01); *H01R 2105/00* (2013.01)

USPC ..... 381/384; 381/386

(58) Field of Classification Search

CPC .... H04R 1/10; H04R 1/1033; H04R 2499/11; H04R 2499/15

USPC ..... 381/333, 388, 334, 123, 384

See application file for complete search history.

(56) References Cited

U.S. PATENT DOCUMENTS

| | | | |
|---|---|---|---|
| 279,471 | A | 6/1883 | Wilson |
| 1,813,167 | A | 7/1931 | Kaisling |
| 2,221,280 | A | 11/1940 | Woodside |
| 2,657,369 | A | 10/1953 | Ziemianin, Jr. |
| 2,857,581 | A | 10/1958 | Henning |
| 4,082,409 | A | 4/1978 | Bailey et al. |
| 4,158,472 | A | 6/1979 | Seiden et al. |

(Continued)

FOREIGN PATENT DOCUMENTS

WO WO 2011062774 A1 5/2011

OTHER PUBLICATIONS

International Search Report; PCT/US20120044174; mailed Nov. 1, 2012.

(Continued)

*Primary Examiner* — Curtis Kuntz
*Assistant Examiner* — Sunita Joshi
(74) *Attorney, Agent, or Firm* — www.bobharter.com; Robert J. Harter

(57) ABSTRACT

An audio jack system includes a special audio jack adaptor that is particularly useful for digital players (e.g., cell phone, smartphone, MP3 player, computer, etc.) housed within watertight enclosures. When a headset is plugged directly into the digital player, the player's audio signal automatically goes to the headset, and the digital player's onboard speaker is silent. When nothing is plugged into the digital player, the audio signal automatically goes to the player's onboard speaker. When just the special adaptor is plugged into the player, the audio signal still goes to the onboard speaker; however, subsequently plugging the headset into the plugged-in special adaptor redirects the audio signal to the headset and not to the onboard speaker. To accomplish such results, a plug end of the adaptor includes a split-ring or split-tip set of open contacts that effectively close upon plugging the headset into a receptacle end of the adaptor.

6 Claims, 12 Drawing Sheets

(56) References Cited

U.S. PATENT DOCUMENTS

| | | | | |
|---|---|---|---|---|
| 4,705,485 | A | 11/1987 | Hansen | |
| 4,733,678 | A | 3/1988 | Bolois | |
| 5,395,264 | A | 3/1995 | Keith | |
| 6,198,821 | B1 * | 3/2001 | Yang | 379/420.04 |
| 6,439,933 | B1 | 8/2002 | Moji | |
| 6,508,676 | B1 | 1/2003 | Xu | |
| 6,533,617 | B1 | 3/2003 | D'Addario | |
| 6,643,550 | B2 | 11/2003 | Westlund et al. | |
| 6,645,013 | B1 | 11/2003 | Toyota et al. | |
| 6,743,056 | B2 | 6/2004 | Kunugi | |
| 6,869,315 | B2 | 3/2005 | Nakai et al. | |
| 7,382,891 | B2 * | 6/2008 | Weikel et al. | 381/384 |
| 7,400,917 | B2 * | 7/2008 | Wood et al. | 455/575.8 |
| 7,404,743 | B2 | 7/2008 | Chen et al. | |
| 7,623,667 | B2 | 11/2009 | Sander et al. | |
| 7,727,029 | B2 * | 6/2010 | Bolin et al. | 439/669 |
| 7,758,365 | B2 | 7/2010 | Purchon | |
| 7,758,366 | B2 | 7/2010 | Masuda et al. | |
| 7,869,608 | B2 | 1/2011 | Sander et al. | |
| 7,896,705 | B2 | 3/2011 | Kawasaki et al. | |
| 7,927,151 | B2 | 4/2011 | Prest et al. | |
| 7,946,871 | B1 | 5/2011 | Yu et al. | |
| 7,950,967 | B2 | 5/2011 | Stiehl | |
| 8,290,537 | B2 * | 10/2012 | Lee et al. | 455/556.1 |
| 2001/0053228 | A1 | 12/2001 | Jones | |
| 2006/0234771 | A1 * | 10/2006 | Shavrov | 455/557 |
| 2009/0110404 | A1 | 4/2009 | Agevik | |
| 2009/0180353 | A1 | 7/2009 | Sander et al. | |
| 2010/0055403 | A1 | 3/2010 | Petz et al. | |
| 2010/0069114 | A1 * | 3/2010 | Lee et al. | 455/556.1 |
| 2010/0216526 | A1 | 8/2010 | Chen et al. | |
| 2010/0226509 | A1 | 9/2010 | Filson et al. | |
| 2010/0279553 | A1 | 11/2010 | Izumi | |
| 2011/0116750 | A1 | 5/2011 | Terlizzi et al. | |

OTHER PUBLICATIONS

International Preliminary Report on Patentability; PCT/US2012/044174; issued Jan. 1, 2014.

* cited by examiner

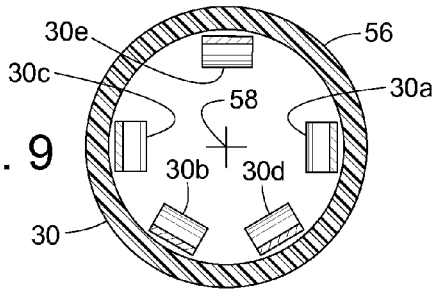
FIG. 9
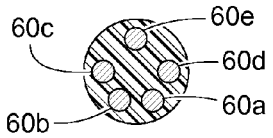
FIG. 10
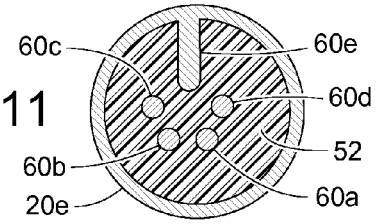
FIG. 11
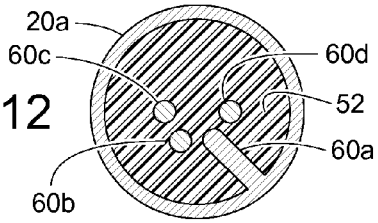
FIG. 12
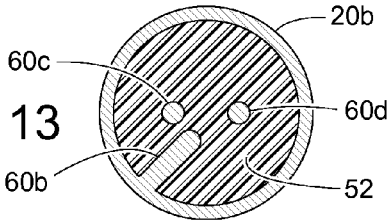
FIG. 13
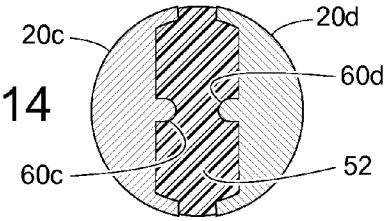
FIG. 14
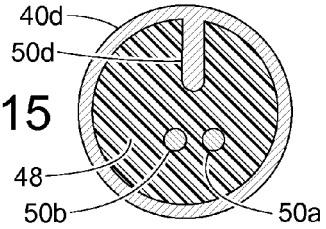
FIG. 15
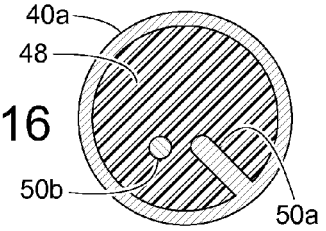
FIG. 16
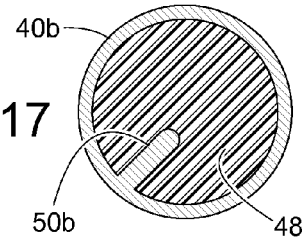
FIG. 17
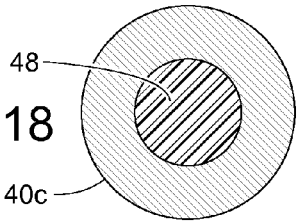
FIG. 18
FIG. 19
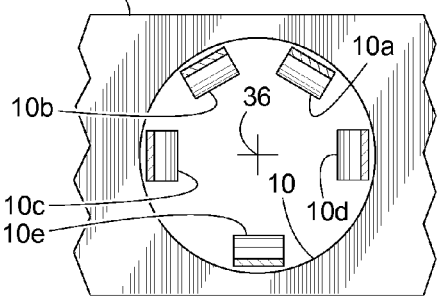

AUDIO JACK SYSTEM

CROSS REFERENCE TO RELATED APPLICATIONS

This application claims the benefit of provisional patent application Ser. No. 61/571,788 filed on Jul. 5, 2011 by the present inventor.

FIELD OF THE INVENTION

The subject invention generally pertains to audio jacks and more specifically to audio jacks comprising a series of ring contacts disposed along a common centerline.

BACKGROUND

Audio jacks are often used for connecting headphones to audio players such as cell phones, digital music players, computers, etc. An audio jack, for example, might comprise a multi-contact plug on the headphones and a mating multi-contact receptacle on the audio player. Inserting the plug of the headphones into the player's mating receptacle may enable the player to transmit audio signals to the headphones. However, water leakage, player inaccessibility, and/or other problems can occur if the audio player is contained within a supposedly water-tight enclosure.

BRIEF DESCRIPTION OF THE DRAWINGS

FIG. 9 is a cross-sectional view taken along line 9-9 of FIG. 8.

FIG. 10 is a cross-sectional view taken along line 10-10 of FIG. 8.

FIG. 11 is a cross-sectional view taken along line 11-11 of FIG. 8.

FIG. 12 is a cross-sectional view taken along line 12-12 of FIG. 8.

FIG. 13 is a cross-sectional view taken along line 13-13 of FIG. 8.

FIG. 14 is a cross-sectional view taken along line 14-14 of FIG. 8.

FIG. 15 is a cross-sectional view taken along line 15-15 of FIG. 8.

FIG. 16 is a cross-sectional view taken along line 16-16 of FIG. 8.

FIG. 17 is a cross-sectional view taken along line 17-17 of FIG. 8.

FIG. 18 is a cross-sectional view taken along line 18-18 of FIG. 8.

FIG. 19 is a partial top view taken along line 19-19 of FIG. 8.

DETAILED DESCRIPTION

Figure 1:
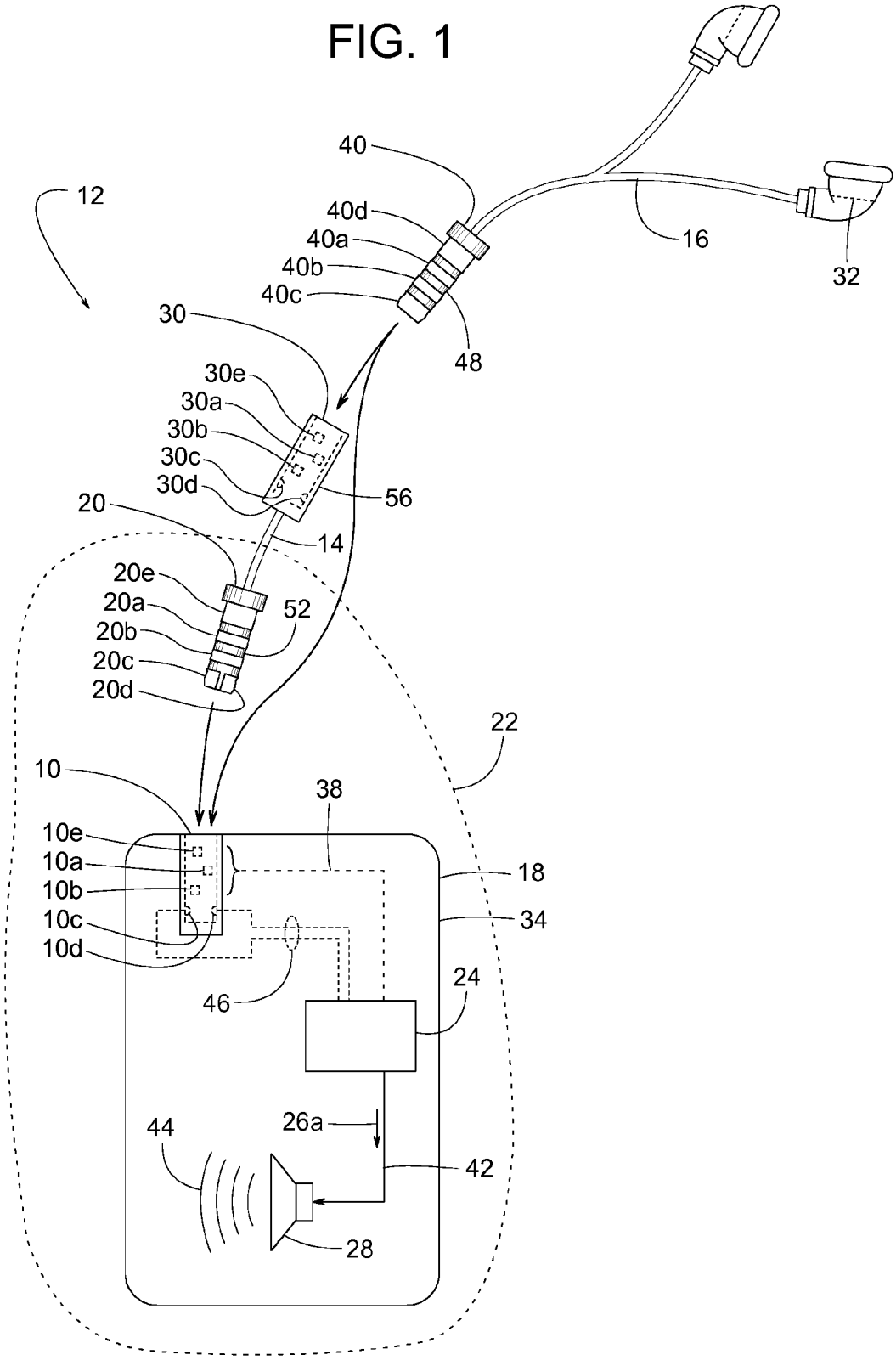
FIG. 1 is a schematic view of an audio jack system according to at least one example of the invention.

FIGS. 1-19 illustrate an example of an audio jack system 12 and/or various portions thereof. In some examples, audio jack system 12 comprises a special adaptor 14 for coupling an auxiliary sound unit 16 to a conventional known digital player 18 in such a way that adaptor 14 is particularly useful when digital player 18 is contained within an optional water-tight enclosure 22.

Depending on the selected connected or disconnected relationship of digital player 18, auxiliary sound unit 16, and adaptor 14, player 18 operates in an onboard speaker mode (FIGS. 1, 3, 6 and 8) or an auxiliary speaker mode (FIGS. 2, 4, 5 and 7). In the onboard speaker mode, an electrical circuit 24 of digital player 18 conveys an audio signal 26*a* to an onboard speaker 28 of player 18 and not to an auxiliary speaker 32 of auxiliary sound unit 16. In the auxiliary speaker mode, circuit 24 conveys an audio signal 26*b* to auxiliary speaker 32 and not to onboard speaker 28.

Figure 2:
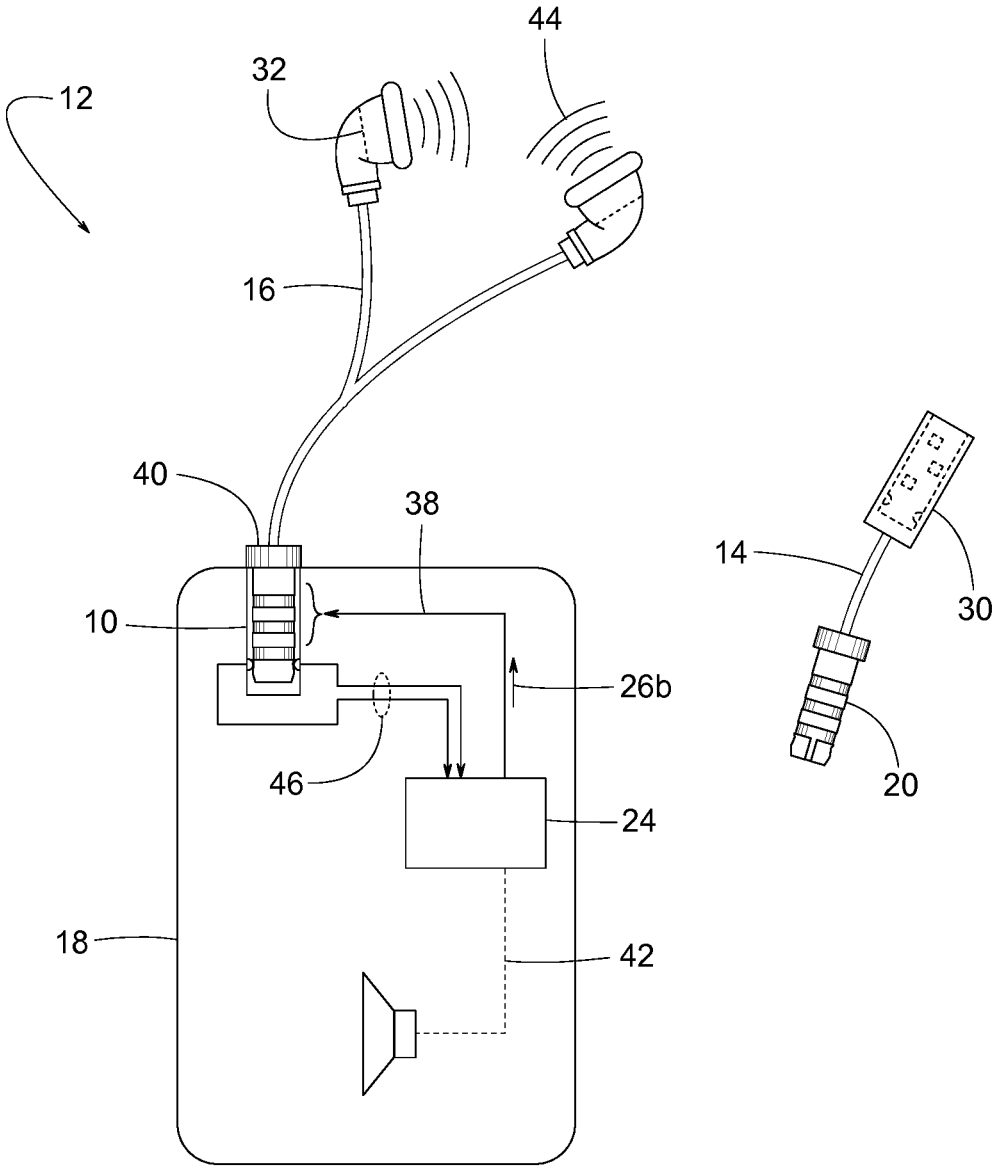
FIG. 2 a schematic view of the audio jack system shown in FIG. 1 but showing an example auxiliary sound unit (e.g., a conventional known headset) plugged into a conventional known digital player's audio socket.
Figure 3:
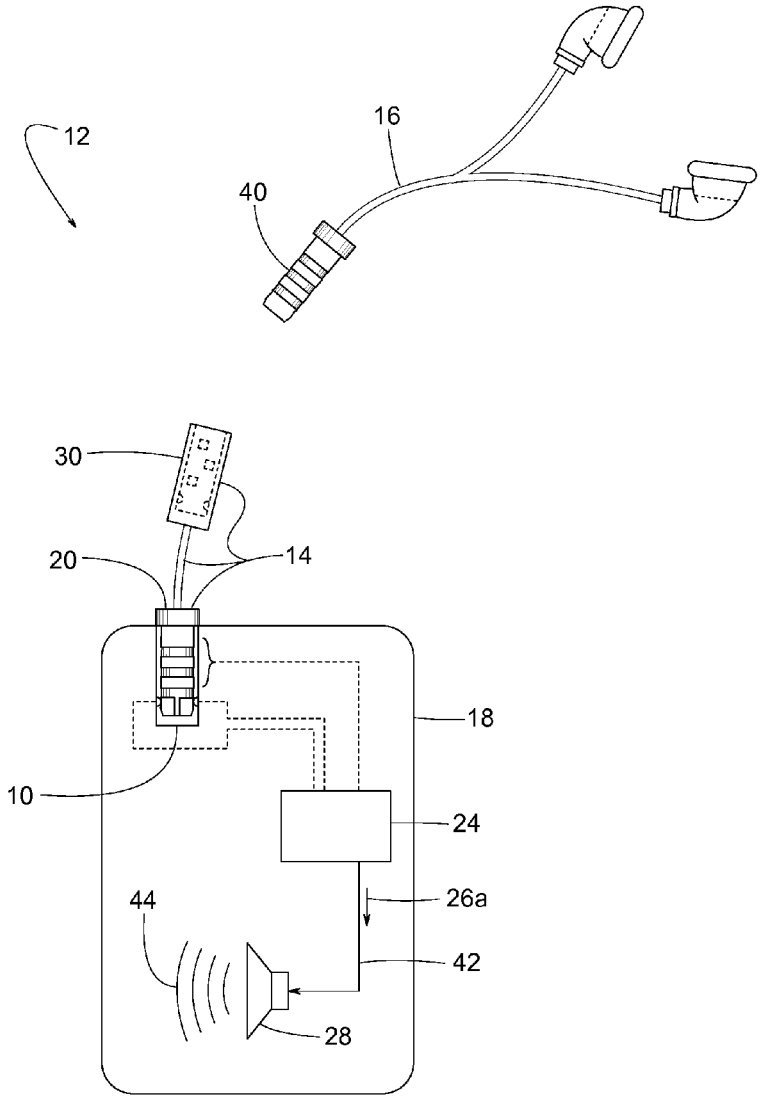
FIG. 3 a schematic view of the audio jack system shown in FIG. 1 but showing a special adaptor plugged into a digital player's audio socket.
Figure 4:
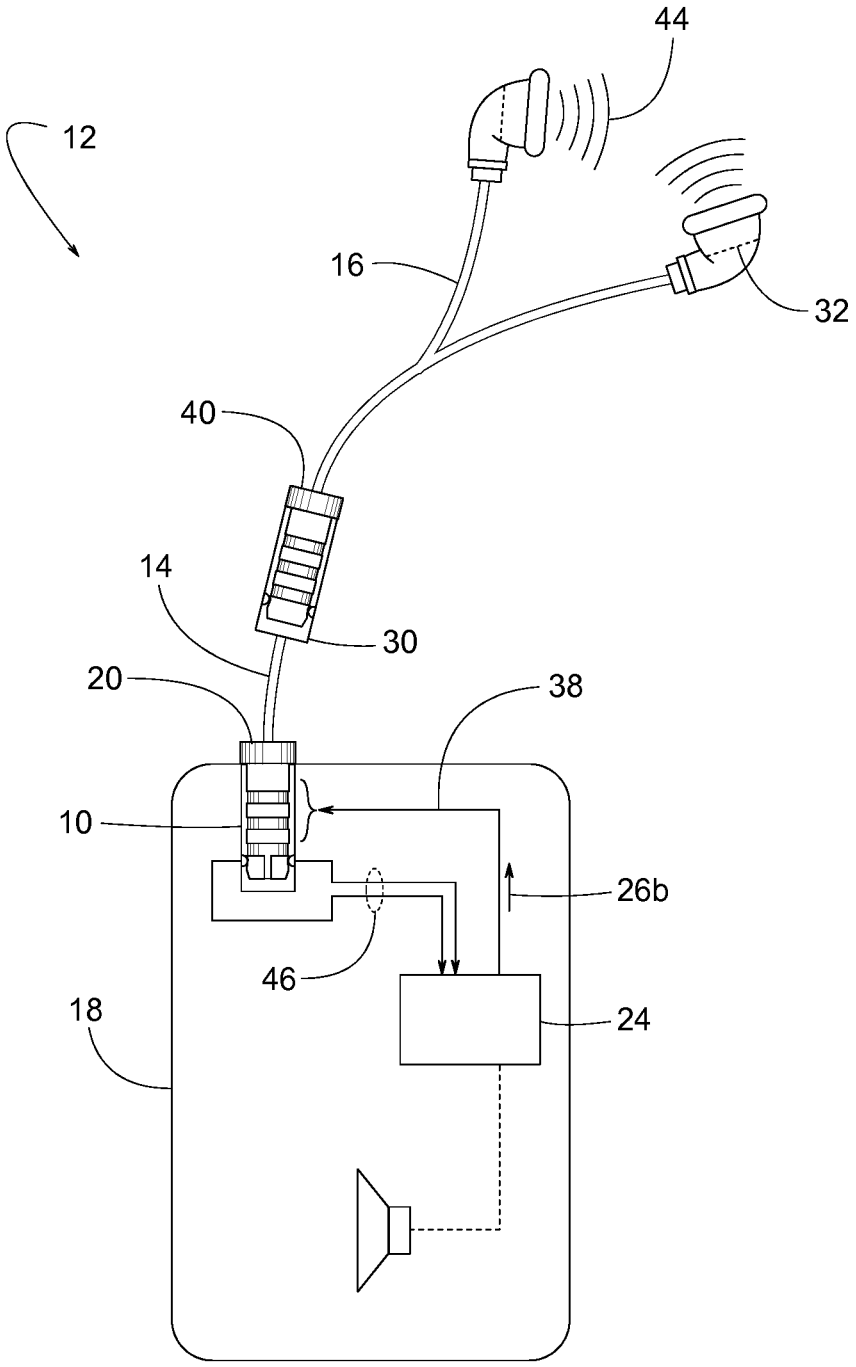
FIG. 4 a schematic view similar to FIG. 3 but showing the auxiliary sound unit plugged into the adaptor.
Figure 5:
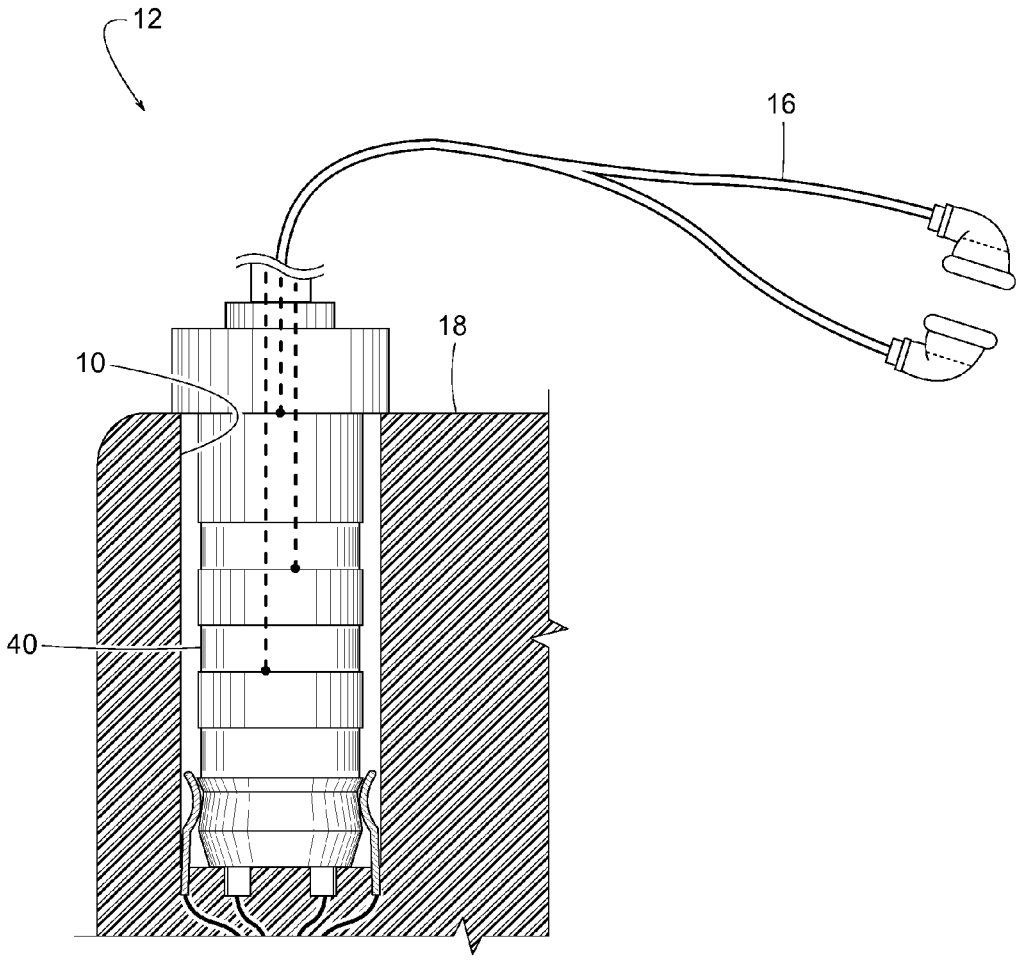
FIG. 5 is a cross-sectional view showing the auxiliary sound unit plugged into the player's audio socket.
Figure 6:
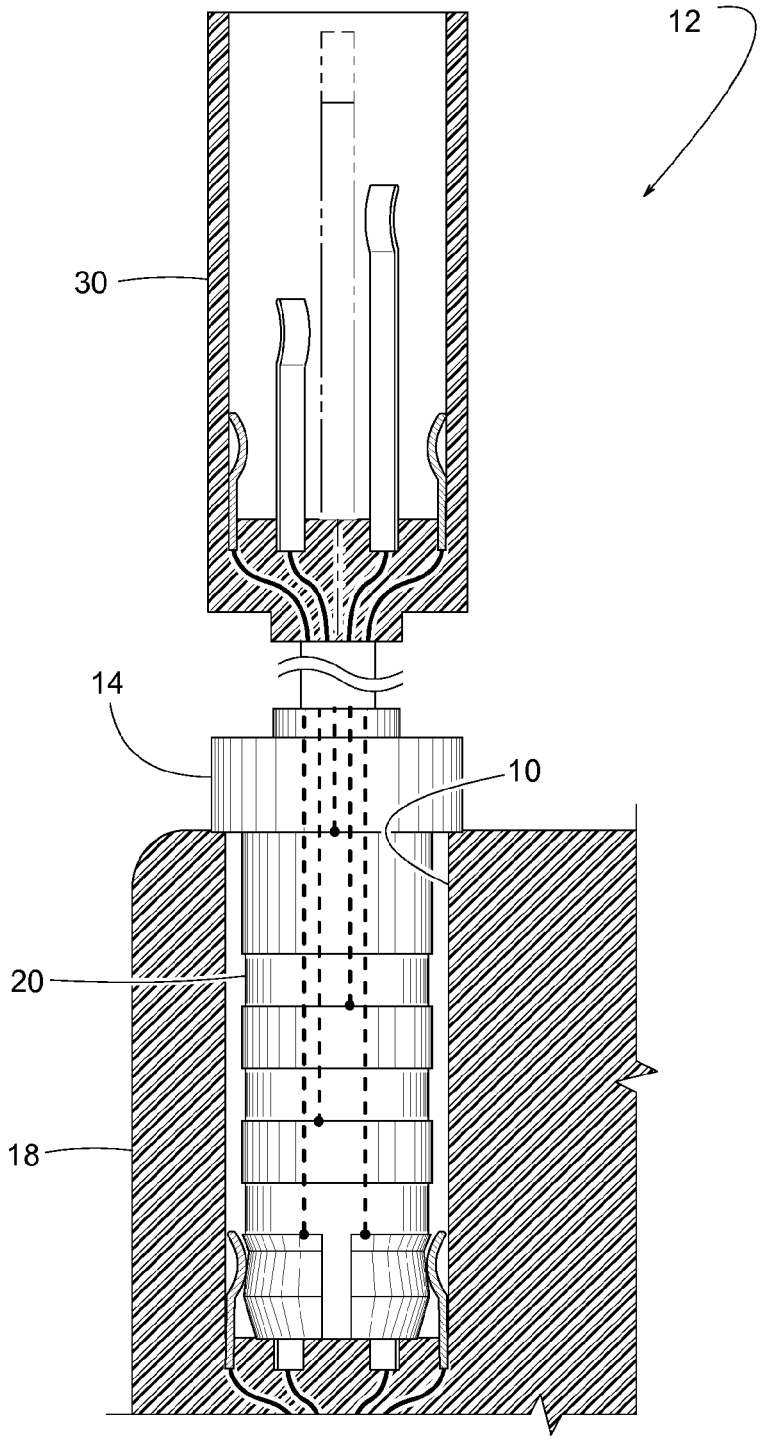
FIG. 6 is a cross-sectional view showing the adaptor plugged into the player's audio socket.
Figure 7:
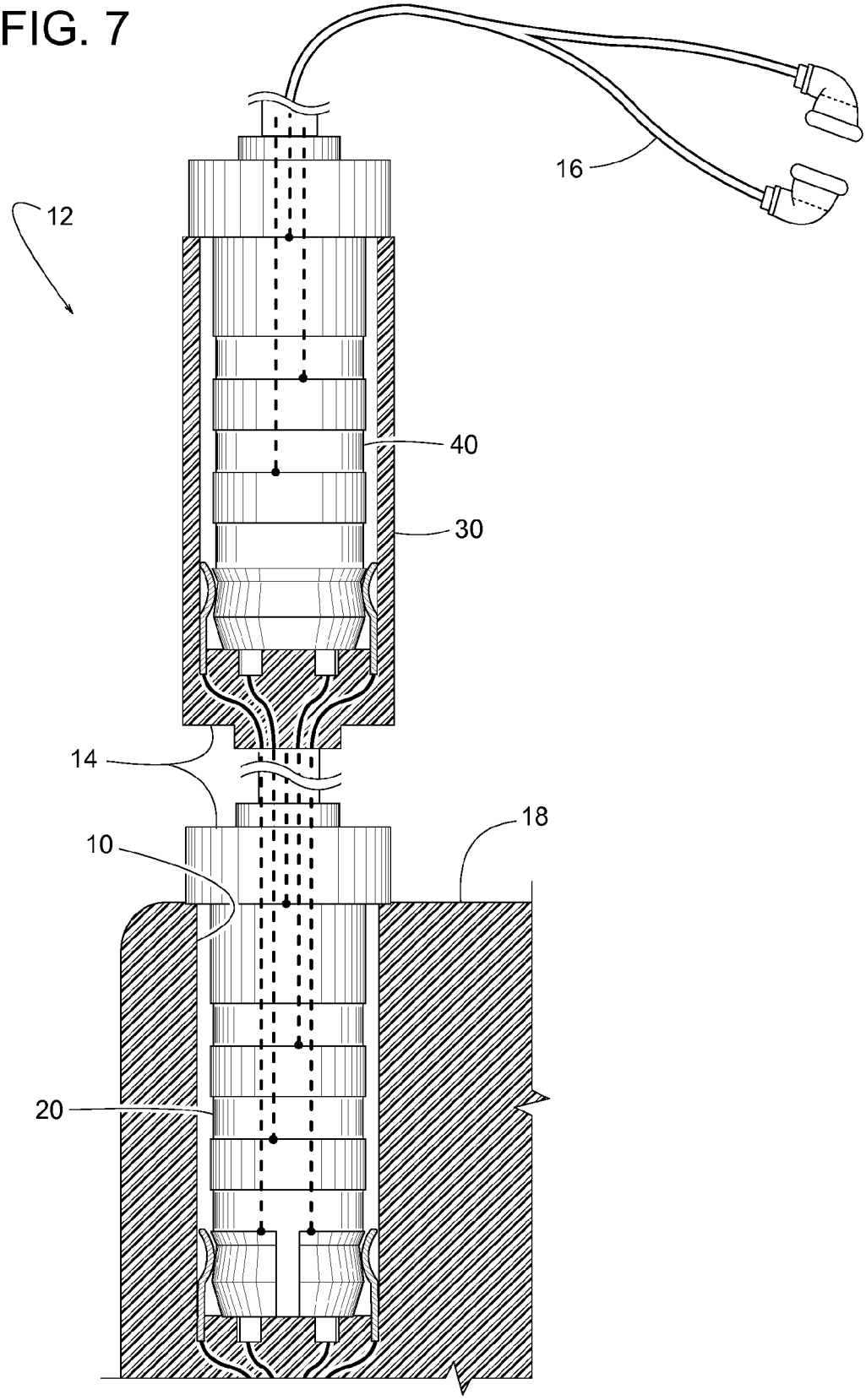
FIG. 7 is a cross-sectional view showing the adaptor plugged into the player's audio socket and the auxiliary sound unit plugged into the adaptor.
Figure 8:
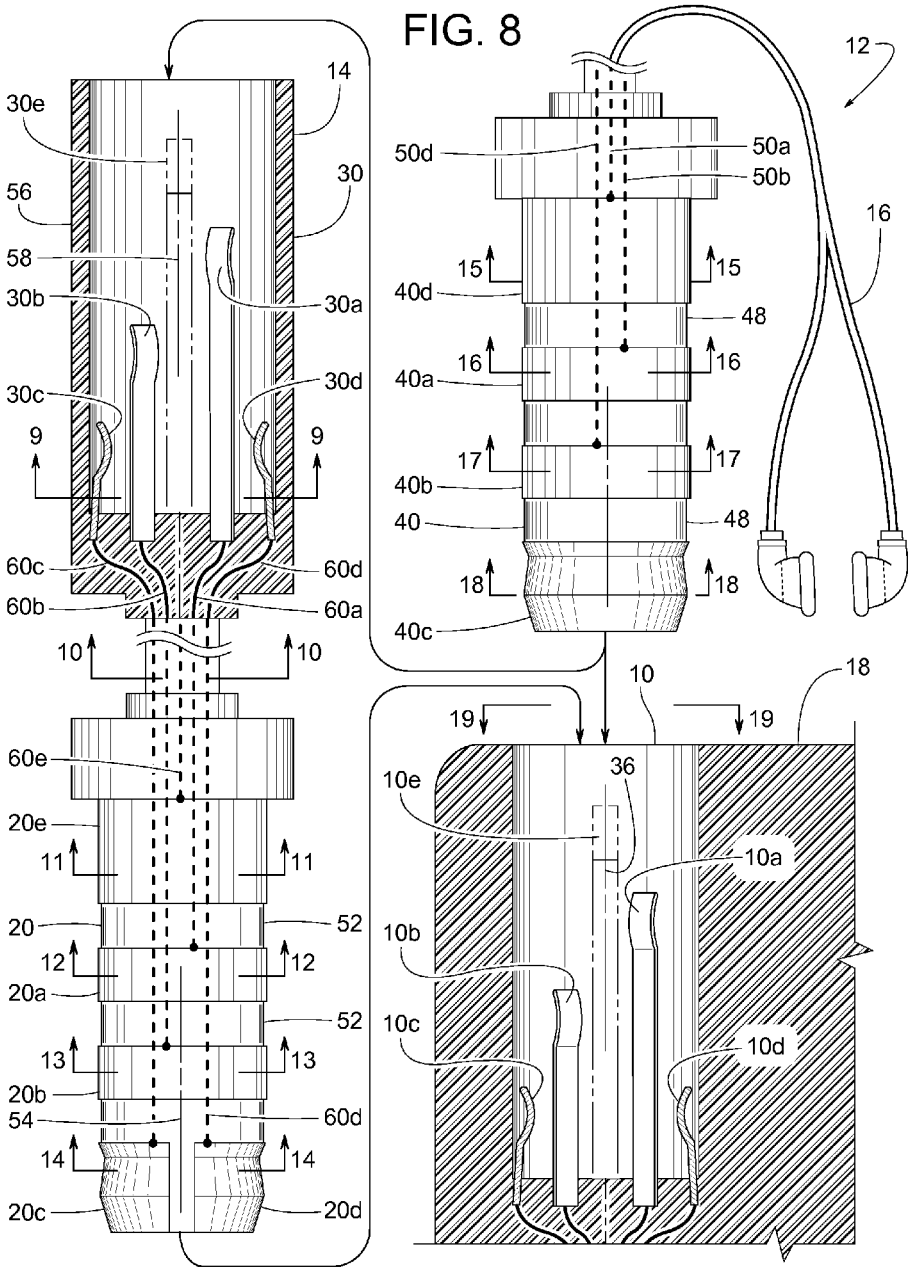
FIG. 8 is a cross-sectional view showing the audio jack system of FIG. 1.
Figure 20:
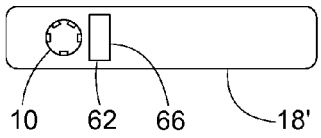
FIG. 20 is a partial top view taken along line 20-20 of FIG. 21.

Player 18 operates in the onboard speaker mode when neither an adaptor plug 20 of adaptor 14 nor an auxiliary plug 40 of auxiliary sound unit 16 are plugged into an audio socket 10 of player 18, as shown in FIGS. 1 and 8. Player 18 also operates in the onboard speaker mode when adaptor plug 20 is plugged into audio socket 10 while auxiliary plug 40 is not plugged into an adaptor receptacle 30 of adaptor 14, as shown in FIGS. 3 and 6. Player 18 operates in the auxiliary speaker mode when auxiliary plug 40 is plugged directly into audio socket 10, as shown in FIGS. 2 and 5. Player 18 also operates in the onboard speaker mode when adaptor plug 20 is plugged into audio socket 10 while auxiliary plug 40 is plugged into adaptor receptacle 30, as shown in FIGS. 4 and 7.

To further understand the operation and relationship of digital player 18, adaptor 14 and auxiliary sound unit 16, it should first be noted that each of them have compatible connectors, such as male plugs and/or female receptacles. Such male and/or female connectors are sometimes known as or examples of which include, but are not limited to, an audio jack, phone jack, jack plug, stereo plug, mini-jack, headphone jack, TS tip-sleeve connector, TRS tip-ring-sleeve connector, TRRS tip-ring-ring-sleeve connector, TRRRS tip-ring-ring-ring-sleeve connector, 3.5 mm audio jack, and 2.5 mm micro audio jack.

Auxiliary sound unit 16 is schematically illustrated to represent any known speaker device (e.g., earphones, headphones, headset, ear buds, desktop speakers, car speaker, etc.) with a known plug connector (e.g., audio jack, phone jack, jack plug, stereo plug, mini-jack, headphone jack, TS tip-sleeve connector, TRS tip-ring-sleeve connector, TRRS tip-ring-ring-sleeve connector, TRRRS tip-ring-ring-ring-sleeve connector, 3.5 mm audio jack, 2.5 mm micro audio jack, etc.).

Digital player 18 is schematically illustrated to represent any electronic device for generating an audio signal than can be converted to sound. Examples of digital player 18 include, but are not limited to, a telephone, digital music player, camera, camcorder, computer, tablet computer, laptop computer, personal digital assistant, video game player, GPS unit (global positioning system), IPHONE, IPOD, IPAD, MP3 player, etc. The terms, iPhone, iPod and iPad are registered trademarks of Apple, Inc. of Cupertino, Calif. Examples of digital device 18 include both portable and generally immobile devices. Some examples of a "telephone" include, but are not limited to, a cell phone, smartphone, satellite phone, etc.

Adaptor 14 is schematically illustrated to represent any electrical coupling comprising a male plug and a female receptacle that can couple auxiliary plug 40 to audio socket 10 and selectively configure player 18 to its onboard speaker mode and its auxiliary speaker mode via the four selective operative arrangements shown in FIGS. 1-4, which are also shown in FIGS. 5-8.

For sake of example, digital player 18, auxiliary sound unit 16 and adaptor 14 will be described herein as having one or more TRRS connections; however, such connections (e.g., plug 20 and socket 10) can have more or less electrically conductive contacts (e.g., rings, sleeves, tabs, etc.) than that of just a TRRS plug or socket. The term "contact" when used as a noun, e.g., electrical contact, headset contact, auxiliary contact, inner adaptor contact, outer adaptor contact, and socket contact, means an electrically conductive surface being sufficiently exposed to touch in electrical continuity another exposed electrically conductive surface.

In some examples, audio socket 10 comprises a first socket contact 10*a*, a second socket contact 10*b*, a third socket contact 10*c*, a fourth socket contact 10*d*, and sometimes at least one other additional socket contact 10*e*.

In some examples, adaptor plug 20 comprises a first outer adaptor contact 20*a*, a second outer adaptor contact 20*b*, a third outer adaptor contact 20*c*, a fourth outer adaptor contact 20*d*, and sometimes at least one other additional outer adaptor contact 20*e*.

In some examples, adaptor receptacle 30 comprises a first inner adaptor contact 30*a*, a second inner adaptor contact 30*b*, a third inner adaptor contact 30*c*, a fourth inner adaptor contact 30*d*, and sometimes at least one other additional inner adaptor contact 30*e*.

In some examples, auxiliary plug 40 comprises a first auxiliary contact 40*a*, a second auxiliary contact 40*b*, a third auxiliary contact 40*c*, and sometimes at least one other additional auxiliary contact 40*d*. Additional contacts, such as 10*e*, 20*e*, 30*e* and 40*d*, are used in some examples as means for conveying various other signals, examples of which include, but are not limited to, stereo audio signals, microphone signals, video signals, etc.

Various examples of audio jack system 12 have their contacts 10*a-d*, 20*a-d*, 30*a-d* and 40*a-c* be of various structure, examples of which include, but are not limited to, a full 360-degree tip, ring or sleeve (e.g., contacts 20*a*, 20*b*, 20*e* and 40*a-c*); a partial tip, ring or sleeve less than 360-degrees (e.g., contacts 20*c* and 20*d*); part of a resiliently flexible electrically conductive tab (e.g., contacts 10*a-d* and 30*a-e*); and various combinations thereof. The term, "tip" generally refers to an outboard or distal end of a plug, the term, "sleeve" generally refers to an inboard end of a plug or socket, and the term, "ring" refers to an annular contact interposed between the inboard and outboard end of a plug or socket.

In some examples, digital player 18 comprises a housing 34 containing electrical circuit 24 and onboard speaker 28. Electrical contacts 10*a-d* are spaced apart and electrically insulated from each other. Referring to FIGS. 8 and 19, in some examples, contacts 10*a-d* are distributed circumferentially about a longitudinal centerline 36 of audio socket 10 and certain audio socket contacts extend various longitudinal distances along audio socket 10 to become aligned with corresponding contacts of adaptor plug 20 and auxiliary plug 40 when those plugs are inserted into audio socket 10.

To convey at least audio signal 26*b* to audio socket 10, electrical lines 38 connect circuit 24 to socket contacts 10*a* and 10*b* and, in some examples, to one or more additional socket contacts 10*e*. To convey an audio signal 26*a* to onboard speaker 28, electrical lines 42 connect circuit 24 to onboard speaker 28. When digital player 18 is turned on to produce sound 44, circuit 24 selectively directs audio signal 26*a* or 26*b* to speaker 28 or 32 respectively. When something closes contacts 10*c* and 10*d* (i.e., connects the two in electrical continuity with each other), electrical lines 46 convey this information to circuit 24, wherein circuit 24 responds by directing audio signal 26*b* through lines 38 to socket contacts 10*a* and 10*b* and does not direct audio signal 26*a* to online speaker 28, whereby player 18 is configured in the auxiliary speaker mode, as shown in FIGS. 2, 4, 5 and 7. When nothing closes contacts 10*c* and 10*d*, circuit 24 directs audio signal 26*a* through lines 42 to online speaker 28 and does not direct audio signal 26*b* to socket contacts 10*a* and 10*b*, whereby player 18 is configured in the onboard speaker mode, as shown in FIGS. 1, 3, 6 and 8.

In some examples, the design of adaptor 14 and auxiliary sound unit 16 are such that inserting auxiliary plug 40 into audio socket 10 closes contacts 10*c* and 10*d* to configure player 18 in the auxiliary speaker mode; inserting adaptor plug 20 and auxiliary plug 40 into audio socket 10 and adaptor receptacle 30, respectively, closes contacts 10*c* and 10*d* to configure player 18 in the auxiliary speaker mode; plugging neither adaptor plug 20 nor auxiliary plug 40 into audio socket 10 leaves contacts 10*c* and 10*d* open to configure player 18 in the onboard speaker mode; and plugging adaptor plug 20 into audio socket 10 while not plugging auxiliary plug 40 into adaptor receptacle 30 leaves contacts 10*c* and 10*d* open to configure player 18 in the onboard speaker mode. To accomplish such results, some examples of adaptor 14 and auxiliary sound unit 16 are structured as follows.

Referring to FIGS. 8 and 15-18, in some examples, auxiliary contacts 40*a-d* are rings axially spaced apart and disposed on a generally non-electrically conductive core 48 (e.g., made of plastic) such that contacts 40*a-d* are electrically insulated (electrically isolated) from each other. Wires 50*a*, 50*b* and 50*d* (plurality of wires) connect auxiliary contacts 40*a*, 40*b* and 40*d* of auxiliary plug 40 to at least one auxiliary speaker 32. When auxiliary plug 40 is plugged directly into audio socket 10, or when auxiliary plug 40 is plugged into adaptor receptacle 30 and adaptor plug 20 is plugged into audio socket 10, wires 50*a*, 50*b* and 50*d* convey audio signal 26*b* to at least one auxiliary speaker 32.

Referring to FIGS. 8 and 10-13, in some examples of adaptor plug 14, outer adaptor contacts 20*a*, 20*b* and 20*e* are rings axially spaced apart and disposed on a generally non-electrically conductive core 52 (e.g., made of plastic) such that contacts 20*a*, 20*b* and 20*e* are electrically insulated from each other. Contacts 20*a*, 20*b* and 20*e* are centrally disposed around a longitudinal centerline 54 of adaptor plug 20. Contacts 20*c* and 20*d* are circumferentially spaced apart from each other and extend less than the full circumferential distance around adaptor plug 20. Contacts 20*c* and 20*d* are electrically isolated from contacts 20*a*, 20*b* and 20*e*. Contacts 20*c* and 20*d* are longitudinally aligned and are equally spaced radially on opposite sides of centerline 54 (contacts 20*c* and 20*d* are substantially equidistant from centerline 54). When auxiliary plug 40 is not plugged into adaptor receptacle 30, contacts 20*c* and 20*d* are electrically isolated from each other.

Referring to FIGS. 8, 9 and 14, in some examples of adaptor 14 and adaptor receptacle 30, inner adaptor contacts 30*a-e* are spaced apart, and a housing 56 that is generally electrically non-conductive (e.g., made of plastic) electrically insulates contacts 30*a-e* from each other. In some examples, contacts 30*a-e* are distributed circumferentially about a longitudinal centerline 58 of adaptor receptacle 30 and certain adaptor receptacle contacts extend various longitudinal distances along adaptor receptacle 30 to become aligned with and engage corresponding contacts of auxiliary plug 40 when auxiliary plug 40 is inserted into adaptor receptacle 30. For example, when auxiliary plug 40 is plugged into adaptor receptacle 30, auxiliary contact 40*d* engages inner adaptor contact 30*e*, auxiliary contact 40*a* engages inner adaptor contact 30*a*, auxiliary contact 40*b* engages inner adaptor contact 30*b*, and auxiliary contact 40*c* engages both inner adaptor contacts 30*c* and 30*d*.

Likewise, when auxiliary plug 40 is plugged into audio socket 10, auxiliary contact 40*d* engages socket contact 30*e*, auxiliary contact 40*a* engages socket contact 30*a*, auxiliary contact 40*b* engages socket contact 30*b*, and auxiliary contact 40*c* engages both socket contacts 30*c* and 30*d*. Similarly, when adaptor plug 20 is plugged into audio socket 10, outer adaptor contact 20*e* engages socket contact 10*e*, outer adaptor contact 20*a* engages socket contact 10*a*, outer adaptor contact 20*b* engages socket contact 10*b*, outer adaptor contact 20*c* engages socket contact 10*c*, and outer adaptor contact 20*d* engages socket contact 10*d*.

Regarding further details of adaptor 14, a first conductor 60*a* electrically connects contact 20*a* to contact 30*a* (i.e., establishes electrical continuity between contacts 20*a* and 30*a*), a second conductor 60*b* electrically connects contact 20*b* to contact 30*b*, a third conductor 60*c* electrically connects contact 20*c* to contact 30*c*, and a fourth conductor 60*d* electrically connects contact 20*d* to contact 30*d*. In some examples, a fifth conductor 60*e* electrically connects contact 20*e* to contact 30*e*. Conductors 60*a-e* are schematically illustrated to represent any means for conveying electricity from one contact to another (same is true for so-called wires 50*a*, 50*b* and 50*d*). Examples of such conductors include, but are not limited to, wires, ribbons (e.g., see U.S. Pat. No. 7,927,151), bars, electrically conductive concentric cylinders (e.g., see U.S. Pat. Nos. 6,439,933; 7,404,734 or 7,950,967), and various combinations thereof. In some examples, such as the adaptors shown in FIGS. 1-25, the adaptors generally have no moving parts other than inherent flexibility of their component parts.

In the example illustrated in FIGS. 1-19, inserting auxiliary plug 40 into audio socket 10 engages auxiliary contact 40*c* with socket contacts 10*c* and 10*d*, thereby closing contacts 10*c* and 10*d* to configure player 18 in the auxiliary speaker mode, as shown in FIGS. 2 and 5.

Alternatively, inserting adaptor plug 20 and auxiliary plug 40 into audio socket 10 and adaptor receptacle 30, respectively, engages outer adaptor contact 20*c* with socket contact 10*c*, engages outer adaptor contact 20*d* with socket contact 10*d*, and engages auxiliary contact 40*c* with both inner adaptor contacts 20*c* and 20*d*. This closes contacts 10*c* and 10*d* because electrical continuity is established from socket contact 10*c*, through outer adaptor contact 20*c*, through conductor 60*c*, through inner adaptor contact 30*c*, through auxiliary contact 40*c*, through inner adaptor contact 30*d*, through conductor 60*d*, and to socket contact 10*d*. Closing socket contacts 10*c* and 10*d* in this manner configures player 18 in the auxiliary speaker mode, as shown in FIGS. 4 and 7.

Although illustrated examples of audio jack system 12 show various contacts at certain axial positions, other examples of system 12 have different axial arrangements of the contacts. In some examples, contacts 10*c* and 10*d*, contacts 20*c* and 20*d*, contacts 30*c* and 30*d*, and contact 40*c* are at other axial locations along their respective plug, socket or receptacle; however, their axial alignment with their corresponding contacts of engagement is maintained.

Figure 22:
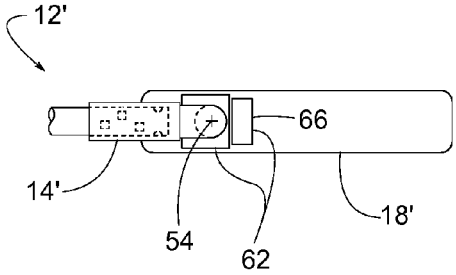
FIG. 22 is a top view of FIG. 23.
Figure 21:
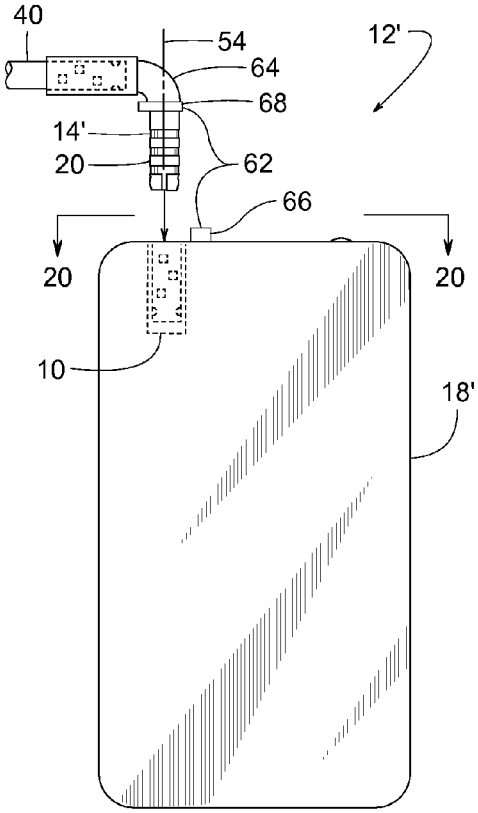
FIG. 21 is a front view of another example audio jack system.
Figure 23:
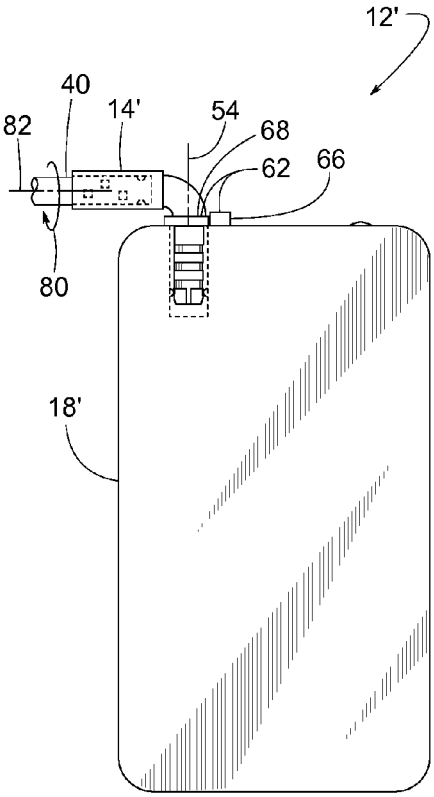
FIG. 23 is a front view similar to FIG. 21 but showing an example adaptor plugged into an example audio player.

In another example, shown in FIGS. 20-23, an audio jack system 12' comprises a digital player 18', an adaptor 14', and a limited rotation feature 62. In this example, conductors 60*a-d* are supported by an elbow 64 that connects adaptor plug 20 to adaptor receptacle 10. Limited rotation feature 62 provides, about centerline 54, a limited range of relative rotation between adaptor plug 20 and audio socket 10 when adaptor plug 20 is disposed within socket 10, as shown in FIGS. 22 and 23. In some examples, limited rotation feature 62 comprises a protrusion 66 on player 18' and a mating flange 68 on adaptor 14'. When adaptor plug 20 is properly plugged into socket 10, as shown in FIGS. 22 and 23, protrusion 66 provides flange 68 with an obstruction that limits the plug's rotation within socket 10. Thus, feature 62 ensures proper rotational alignment of outer adaptor contacts 20*c* and 20*d* with corresponding socket contacts 10*c* and 10*d*. It should be noted that feature 60 is schematically illustrated to represent countless means for ensuring proper rotational alignment between adaptor plug 20 and audio socket 10.

Figure 24:
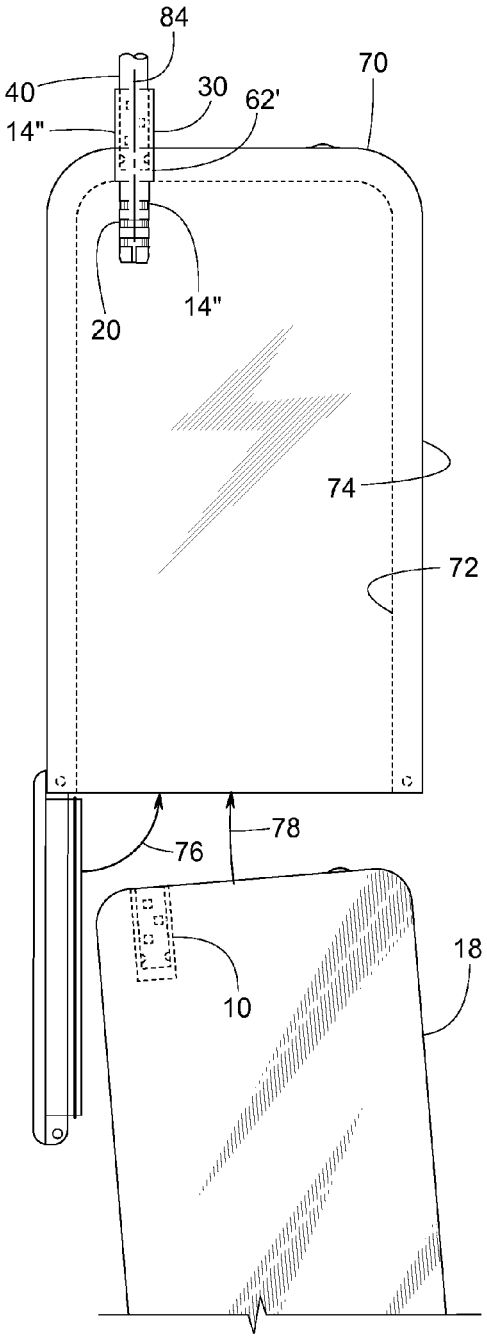
FIG. 24 is a front view of an audio player being inserted into an example enclosure.
Figure 25:
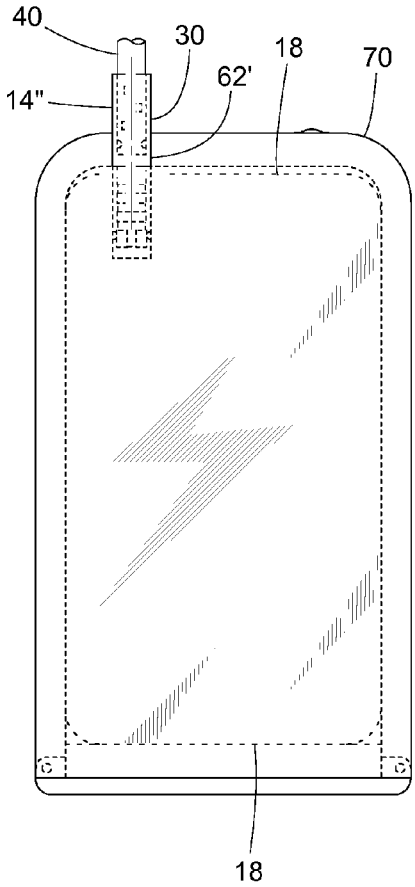
FIG. 25 is a front view similar to FIG. 24 but showing the audio player sealed inside the enclosure.

FIGS. 24 and 25, for instance, show a limited rotation feature 62' provided by an adaptor 14" being rotationally fixed relative to an enclosure 70 (e.g., watertight enclosure 22 of FIG. 1). In some examples, enclosure 70 defines an interior 72 and an exterior 74 that are substantially hermetically isolated from each other when enclosure 70 is closed, as shown in FIG. 25. Thus, when player 18 is contained within the enclosure's interior 72 and auxiliary plug 40 is plugged into adaptor receptacle 30, player 18 is substantially hermetically isolated from auxiliary sound unit 16. The term, "hermetically isolated" means that liquid water is substantially blocked against appreciable leakage when subjected to a pressure differential of about 0.01 kg/cm$^2$. In the illustrated example, adaptor plug 20 extends into the enclosure's interior 72, and adaptor receptacle 30 is exposed to the enclosure's exterior environment 74. FIG. 24 shows player 18 being installed inside enclosure 70, and FIG. 25 shows player 18 properly installed within enclosure 70. Arrows 76 and 78 of FIG. 24 represent hermetically sealing digital player 18 and adaptor plug 20 within interior 72 of enclosure 70 while exposing adaptor receptacle 30 and auxiliary sound unit 16 to the enclosure's exterior environment 74. In this example, enclosure 70 is of a shape that guides digital player 18 along a certain path that ensures that audio socket 10 of player 18 properly docks with adaptor plug 20, such that socket contacts 10*c* and 10*d* are in proper rotational alignment and axial alignment with outer adaptor contacts 20*c* and 20*d*.

In examples where there is limited relative rotation between adaptor plug 20 and the player's audio socket 10, as illustrated in FIGS. 20-25, there exists between auxiliary plug 40 and adaptor receptacle 30 a 360-degree range of relative rotation about a second longitudinal centerline (e.g., a centerline 82 and 84) when auxiliary plug 40 is disposed within the adaptor receptacle 30. Arrow 80 of FIG. 23 illustrates allowing generally unrestricted relative rotation between auxiliary plug 40 and adaptor receptacle 30 about centerline 82. Such freedom of rotation not only makes it easier to insert auxiliary plug 40 into adaptor receptacle 30 but also helps prevent the wires of auxiliary sound unit 16 from getting twisted or tangled.

Figure 26:
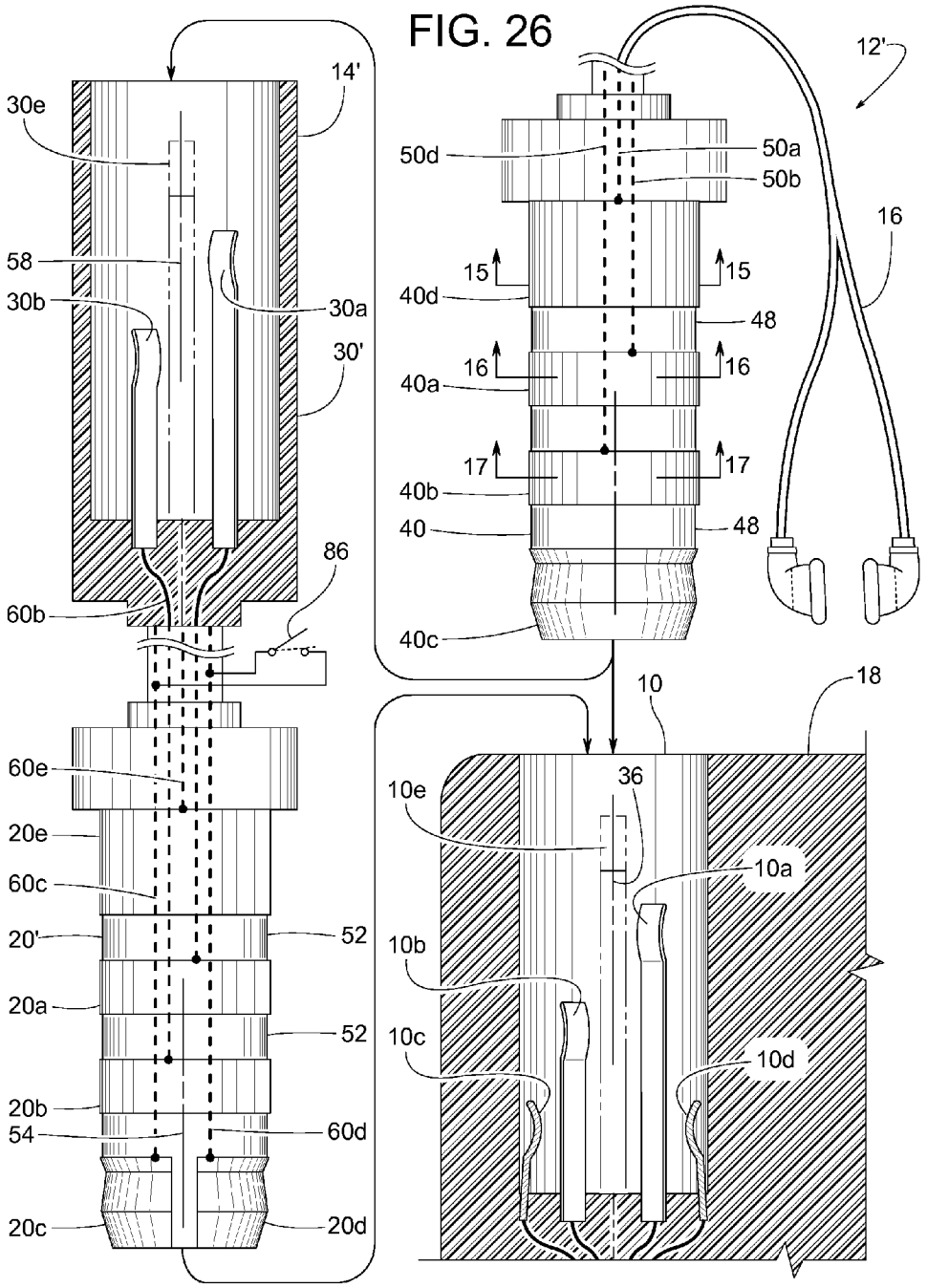
FIG. 26 is a cross-sectional view similar to FIG. 8 but showing an example audio jack system with an example adaptor that includes a switch, wherein the switch is schematically illustrated.

FIG. 26 shows an example audio jack system 12' wherein an adaptor 14' includes a switch 86 operatively connected or wired to conductors 60*c* and 60*d* of adaptor 14'. FIG. 26 shows switch 86 being selectively moveable to an open position (solid line) and a closed position (dashed line). In the closed position, switch 86 establishes electrical continuity between conductors 60*c* and 60*d* as an alternative to contact 40*c* serving that function. Thus, switch 86 and contact 40*c* are examples of an electrical shunt that when closed and engaged provide electrical continuity that inherently establishes and maintains substantially zero voltage potential across the set of contacts 10*c* and 10*d* (via plug 40 or 20' being plugged into socket 10). In the open position, switch 86 breaks electrical continuity (providing electrical discontinuity) between conductors 60*c* and 60*d*. With the addition of switch 86, in some examples of adaptor 14', contacts 30*c* and 30*d* are omitted.

Consequently, regardless of whether the auxiliary plug 40 is in engagement with adaptor receptacle 30' or is spaced apart from adaptor receptacle 30', digital player 18 is configured in the onboard speaker mode conveying audio signal 26*a* to onboard speaker 28 and not to auxiliary speaker 32 when adaptor plug 20' is in engagement with audio socket 10 and switch 86 is in the open position. Also, regardless of whether switch 86 is in the open position or in the closed position, digital player 18 is configured in the onboard speaker mode conveying audio signal 26*a* to onboard speaker 28 and not to auxiliary speaker 32 when adaptor plug 20' is in disengagement with audio socket 10 and auxiliary plug 40 is spaced apart from the audio socket. Further, digital player 18 is configured in the auxiliary speaker mode conveying audio signal 26*b* to auxiliary speaker 32 and not to onboard speaker 28 when adaptor plug 20' is in audio socket 10, switch 86 is in the closed position, and auxiliary plug 40 is in engagement with adaptor receptacle 30'.

Although the invention is described with respect to a preferred embodiment, modifications thereto will be apparent to those of ordinary skill in the art. The scope of the invention, therefore, is to be determined by reference to the following claims:

The invention claimed is:

1. An audio jack system comprising:

a digital player generating an audio signal, the digital player defining an audio socket that includes a set of socket contacts, the digital player comprising an onboard speaker, the digital player being configured selectively between an onboard speaker mode and an auxiliary speaker mode based on whether electrical continuity exists across the set of socket contacts;

an adaptor comprising an adaptor plug and an adaptor receptacle, the adaptor plug being movable selectively to engagement with the set of socket contacts of the audio socket and to disengagement with the set of socket contacts of the audio socket;

an auxiliary sound unit comprising an auxiliary plug, a plurality of wires, and an auxiliary speaker; the plurality of wires extending between the auxiliary plug and the auxiliary speaker, the auxiliary plug being movable selectively to engagement with the audio socket, to engagement with the adaptor receptacle, and to spaced apart relationship with both the audio socket and the adaptor receptacle, the digital player being configured in the onboard speaker mode conveying the audio signal to the onboard speaker and not to the auxiliary speaker when the adaptor plug is in the audio socket and the auxiliary plug is in spaced apart relationship with both the audio socket and the adaptor receptacle, the digital player being configured in the auxiliary speaker mode conveying the audio signal to the auxiliary speaker and not to the onboard speaker when the auxiliary plug is in engagement with the audio socket, and the digital player being configured in the auxiliary speaker mode conveying the audio signal to the auxiliary speaker and not to the onboard speaker when the adaptor plug is in engagement with the audio socket while the auxiliary plug is in engagement with the adaptor receptacle; and an electrical shunt borne by at least one of the auxiliary plug and the adaptor, the electrical shut being spaced apart from the auxiliary speaker by virtue of the plurality of wires extending between the auxiliary speaker and the auxiliary plug, the electrical shunt providing electrical continuity that establishes and maintains substantially zero voltage potential across the set of socket contacts when the auxiliary plug is in engagement with the audio socket, the electrical shunt providing electrical continuity that establishes and maintains substantially zero voltage potential across the set of socket contacts when the adaptor plug is in engagement with the audio socket while the auxiliary plug is in engagement with the adaptor receptacle, and the electrical shut providing electrical discontinuity between the set of socket contacts when the adaptor plug is in the audio socket and the auxiliary plug is in spaced apart relationship with both the audio socket and the adaptor receptacle.

2. The audio jack system of claim 1, further comprising an enclosure defining an interior and an exterior, the digital player being disposed within the interior, the adaptor plug extending into the interior, and the adaptor receptacle being exposed to the exterior.

3. The audio jack system of claim 2, wherein the interior is substantially hermetically isolated from the exterior, and the digital player is substantially hermetically isolated from the auxiliary sound unit.

4. The audio jack system of claim 1, wherein the auxiliary sound unit is a headset.

5. An audio jack system comprising:

a digital player generating an audio signal, the digital player defining an audio socket that includes a set of socket contacts, the digital player comprising an onboard speaker, the digital player being configured selectively between an onboard speaker mode and an auxiliary speaker mode;

an adaptor comprising an adaptor plug and an adaptor receptacle, the adaptor plug being movable selectively to engagement with the audio socket and to disengagement with the audio socket;

a switch borne by the adaptor, the switch being selectively movable to an open position and a closed position; and an auxiliary sound unit comprising an auxiliary plug and an auxiliary speaker, the auxiliary plug being movable selectively to engagement with the audio socket, to engagement with the adaptor receptacle, and to spaced apart relationship with both the audio socket and the adaptor receptacle, the audio jack system being selectively configured as follows:

a) regardless of whether the auxiliary plug is in engagement with the adaptor receptacle or is spaced apart from the adaptor receptacle, the digital player being configured in the onboard speaker mode conveying the audio signal to the onboard speaker and not to the auxiliary speaker when the adaptor plug is in engagement with the audio socket and the switch is in the open position;

b) regardless of whether the switch is in the open position or in the closed position, the digital player being configured in the onboard speaker mode conveying the audio signal to the onboard speaker and not to the auxiliary speaker when the adaptor plug is in disengagement with the audio socket and the auxiliary plug is spaced apart from the audio socket; and c) the digital player being configured in the auxiliary speaker mode conveying the audio signal to the auxiliary speaker and not to the onboard speaker when the adaptor plug is in the audio socket, the auxiliary plug is in engagement with the adaptor receptacle, and the switch is in the closed position providing electrical continuity that establishes and maintains substantially zero voltage potential across the set of socket contacts.

6. The audio jack system of claim 5, wherein the auxiliary sound unit is a headset.

* * * * *